US009850109B2

(12) United States Patent
Schoonmaker

(10) Patent No.: US 9,850,109 B2
(45) Date of Patent: Dec. 26, 2017

(54) CRANE 3D WORKSPACE SPATIAL TECHNIQUES FOR CRANE OPERATION IN PROXIMITY OF OBSTACLES

(71) Applicant: Manitowoc Crane Companies, LLC, Manitowoc, WI (US)

(72) Inventor: Stephen J. Schoonmaker, Chambersburg, PA (US)

(73) Assignee: MANITOWOC CRANE COMPANIES, LLC, Manitowoc, WI (US)

( * ) Notice: Subject to any disclaimer, the term of this patent is extended or adjusted under 35 U.S.C. 154(b) by 53 days.

(21) Appl. No.: 14/974,812

(22) Filed: Dec. 18, 2015

(65) Prior Publication Data

US 2016/0176686 A1 Jun. 23, 2016

Related U.S. Application Data

(60) Provisional application No. 62/096,041, filed on Dec. 23, 2014.

(51) Int. Cl.

| | |
|---|---|
| ***B66C 15/04*** | (2006.01) |
| ***B66C 23/88*** | (2006.01) |
| ***B66C 23/90*** | (2006.01) |

(52) U.S. Cl.

CPC ..... *B66C 15/045* (2013.01); *B66C 23/88* (2013.01); *B66C 23/905* (2013.01)

(58) Field of Classification Search

CPC ..... B66C 15/045; B66C 23/88; B66C 23/905

See application file for complete search history.

(56) References Cited

U.S. PATENT DOCUMENTS

| | | | | |
|---|---|---|---|---|
| 6,202,013 | B1 * | 3/2001 | Anderson | B66C 13/40 212/276 |
| 6,826,452 | B1 * | 11/2004 | Holland | B66C 1/663 318/566 |
| 8,346,468 | B2 * | 1/2013 | Emanuel | G05D 1/0289 340/901 |
| 9,300,954 | B2 * | 3/2016 | Tanizumi | B60R 1/00 |
| 9,302,890 | B1 * | 4/2016 | Vogt | B66C 13/48 |
| 9,611,732 | B2 * | 4/2017 | Rempe | E21B 47/0905 |
| 2008/0004898 | A1 * | 1/2008 | Hubler | B66C 23/905 703/7 |
| 2009/0083100 | A1 | 3/2009 | Darby, Jr. et al. | |

(Continued)

FOREIGN PATENT DOCUMENTS

| | | | | |
|---|---|---|---|---|
| EP | 1868150 A2 | | 12/2007 | |
| JP | 2002-176641 | * | 6/2002 | H04N 7/18 |

(Continued)

OTHER PUBLICATIONS

European Search Report issued by ISA/EPO in connection with EP15202088 dated Apr. 29, 2016.

*Primary Examiner* — Calvin Chueng

(74) *Attorney, Agent, or Firm* — Levenfeld Pearlstein, LLC

(57) ABSTRACT

A method for controlling a boom of a crane in proximity of obstacles at a worksite by defining a forbidden volume is disclosed. In the method a distance from the boom to an outer surface of the forbidden volume is determined and a computing device limits movement of the boom based on the distance from the boom to the outer surface of the forbidden volume to avoid entering the forbidden volume with the boom while the crane is in operation.

22 Claims, 10 Drawing Sheets

(56) References Cited

U.S. PATENT DOCUMENTS

| | | | | |
|---|---|---|---|---|
| 2011/0010033 | A1* | 1/2011 | Asahara | G05D 1/024 701/26 |
| 2011/0295496 | A1* | 12/2011 | Petrie | B60T 7/22 701/117 |
| 2013/0013251 | A1 | 1/2013 | Schoonmaker et al. | |
| 2016/0341041 | A1* | 11/2016 | Puura | G01S 17/42 |

FOREIGN PATENT DOCUMENTS

| | | | | |
|---|---|---|---|---|
| JP | 2010-241548 | * | 10/2010 | B66C 23/88 |
| JP | 2010-248777 | * | 11/2010 | E04G 23/08 |
| WO | 9220608 | A1 | 11/1992 | |
| WO | 2014046213 | A1 | 3/2014 | |
| WO | WO2014/046213 | * | 3/2014 | G01B 11/02 |

* cited by examiner

CRANE 3D WORKSPACE SPATIAL TECHNIQUES FOR CRANE OPERATION IN PROXIMITY OF OBSTACLES

BACKGROUND

Construction jobsites typically contain a variety of elements such as equipment, power lines, structures, building materials, and personnel. Depending on the phase of a project, there are changing arrangements of these elements while the building project itself progresses toward completion. During any given phase, however, a crane operator is required to take safety precautions so as not to run the boom into obstacles during operation of the crane. To do so, the crane operator often requires another worker on the ground that spots and watches for any impending problems, such as coming too close to an obstacle. This worker may then signal to the crane operator to move away from the obstacle or to shut the crane down. This includes inefficiencies and the need to pay the worker for just monitoring crane function visually.

The ability to alter crane functions with respect to defined areas or forbidden zones within the operational radius of cranes has been made generally available to the construction industry. This capability has evolved as the use of electronics and software for control systems has progressed. This capability is utilized in an operator aid device that can be referred to as a Working Range Limiter or WRL. When a WRL typically defines a forbidden zone it is seen as a map as viewed from above the jobsite.

A traditional WRL is useful for avoiding obstacles when the obstacles occur in the plane of movement, but fails when the geometry becomes more complicated. For example, if a building is marked as a forbidden zone to prevent a boom from impacting the building, a mobile crane will never be able to lift a load to the top of the building because to do so necessarily entails a portion of the crane entering the forbidden zone. If instead, the building is not designated as being in the forbidden zone, the crane could accidently swing into building when swinging the boom.

It would be beneficial to develop a system that inhibits collisions between a crane and obstacles like a traditional WRL system, while allowing the crane to extend into what would traditionally be considered a forbidden zone.

BRIEF DESCRIPTION

A method for controlling a boom of a crane in proximity of obstacles at a worksite is disclosed. In one aspect, the method includes saving, in the memory, coordinate data representing a coordinate system at the worksite; saving, in the memory, obstacle data representing a forbidden volume in the coordinate system; saving, in the memory, boom data representing the location of the boom; and limiting movement of the boom, by the computing device, to avoid the boom entering the forbidden volume, the limiting based on a computed minimum distance between the boom and the forbidden volume using the coordinate data, the obstacle data, and the boom data.

In some embodiments, saving obstacle data includes inputting data representing the forbidden volume. In some embodiments, the boom rotates relative to the crane about a central axis, and saving coordinate data includes saving data representing the central axis.

In some embodiments, saving obstacle data includes using the boom to identify at least two coordinates of the forbidden volume. In some embodiments, the forbidden volume is a rectangular prism and the at least two coordinates include the front, top left corner of the forbidden volume and the front, top right corner of the forbidden volume.

In some embodiments, the crane includes lower works, upper works rotatable relative to the lower works about an axis of rotation, and the boom is disposed on the upper works, and using the boom to identify at least two coordinates of the forbidden volume includes aiming the boom in a first direction at a front face of the forbidden volume and determining a horizontal distance between the face and the axis of rotation to determine a first vector corresponding to the front face of the forbidden volume; aiming the boom in a second direction at a front, top left corner of the forbidden volume and determining a second vector corresponding to the second direction of the boom; intersecting the second vector and the plane to define a first coordinate of the obstacle data; aiming the boom in a third direction at a front, top right corner of the forbidden volume and determining a third vector corresponding to the third direction of the boom; and intersecting the third vector and the plane to define a second coordinate of the obstacle data. In some embodiments, aiming the boom includes at least one of aligning the boom using a video camera attached to the boom and aligning the boom using a laser pointer attached to the boom.

In some embodiments, limiting movement of the boom includes establishing a slowdown threshold distance between the boom and the forbidden volume; and changing a crane function responsive to the computed minimum distance between the boom and the forbidden volume being less than the threshold distance. In some embodiments, changing the crane function includes slowing down the movement of the boom in at least one direction that moves the boom closer to the forbidden volume. In some embodiments, limiting movement of the boom further includes establishing a shutdown threshold distance between the boom and the forbidden volume; and stopping the movement of the boom in response to the computed minimum distance between the boom and the forbidden volume being less than the shutdown threshold distance. In some embodiments, the crane function is selected from the group consisting of telescoping in, telescoping out, booming up, booming down, swinging left, and swinging right.

In some embodiments, the method further includes computing, with the computing device, a maximum swing angle of the boom, a maximum extension of the boom, a maximum boom-up, and a maximum boom-down of the boom.

In some embodiments, determining a horizontal distance between the face and the axis of rotation comprises measuring a distance from the axis of rotation to the face.

In some embodiments, determining a horizontal distance between the face and the axis of rotation comprises placing a hook of the crane proximate the forbidden volume; and using a rated capacity indicator (RCL) hook radius to determine the horizontal distance.

In some embodiments, the data representing the forbidden volume is a building information model, and saving obstacle data comprises aligning the building information model in the coordinate system.

In another aspect a system for controlling a boom of a crane in proximity of obstacles at a worksite is disclosed. The system includes a crane control system configured to control operation of a crane boom; a processor in operable communication with the crane control system; and memory in operable communication with the processor, the memory storing data includes data representing a coordinate system; data representing the crane boom; data representing a forbidden volume; and computer executable instructions for execution by the processor, the computer executable instruction configured to calculate a minimum distance between the crane boom and the forbidden volume based on the data representing the crane boom and the data representing the forbidden volume, and to cause the crane control system to limit movement of the boom based on the calculated minimum distance.

In some embodiments, the computer executable instructions are further configured to determine at least two coordinates of the forbidden volume using the boom. In some embodiments, the system further includes a boom aiming system for aiming the boom at the at least two coordinates of the forbidden volume. In some embodiments, the boom aiming system is a system selected from the group consisting of a laser pointer and a video camera system. In some embodiments, the crane control system limits the motion of the boom in response the calculated minimum distance being less than a threshold distance, and the data further includes a threshold distance value. In some embodiments the crane control system stops the motion of the boom in response to the calculated minimum distance being less than a critical distance, and the data further includes a critical distance value. In some embodiments, the data representing the forbidden volume is a building information model, and the computer executable instructions are further configured to establish the location of the forbidden volume within the coordinate system using the boom.

DETAILED DESCRIPTION

The present embodiments will now be further described. In the following passages, different aspects of the embodiments are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

Figure 1:
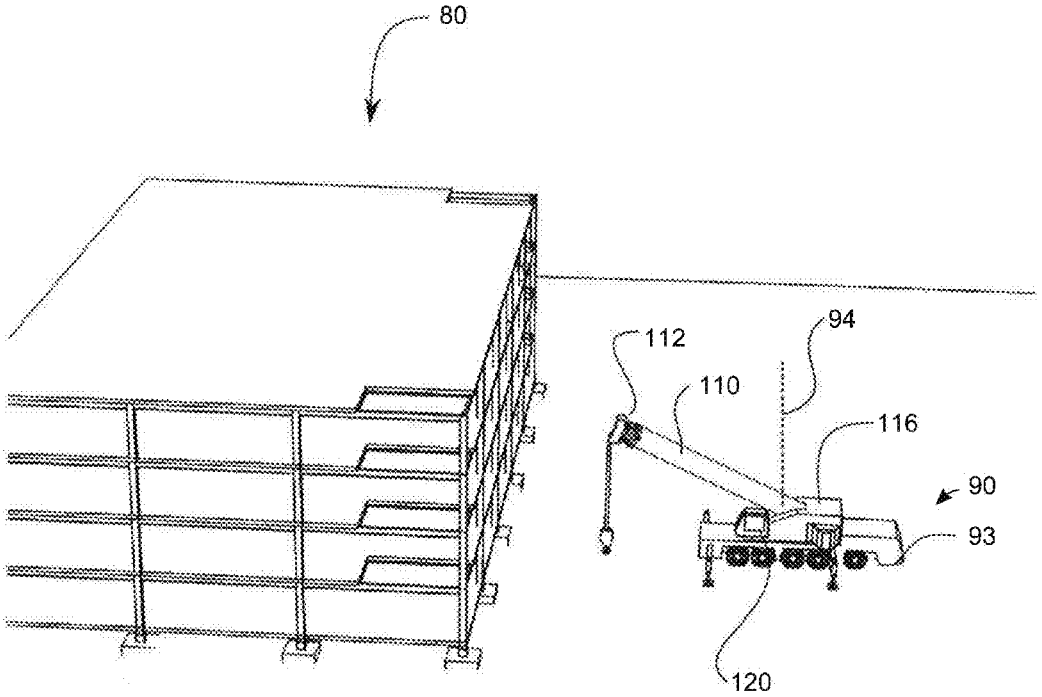
FIG. 1 is a perspective view of a crane and building under construction.

FIG. 1 is a perspective view of a crane 90 and a building 80 under construction. The crane 90 may have a lower works 93 for engagement with the ground, and a cab 120 attached to a rotating bed 116, also referred to as upper works. The rotating bed 116 rotates about an axis 94 of rotation relative to the lower works 93. A boom 110 may also be attached to the rotating bed 116 and be controlled by a computing device, such as a computer system (300 in FIG. 3) located in the cab 120, and by crane controllers controlled by the computing device. The boom 110 may include a telescoping portion 112 at an end of the boom 110 that may be extended (tele-out) or retracted (tele-in) by controls within the cab 120. The use of the cab 120 and the location of the computing device is merely exemplary and a computing device need not be located within the cab 120. For example, the computing device could be integrated in to the lower works of the crane 93.

The computing device and controls may also control the movement of the rotating bed 116, which causes the boom 110 to swing left and swing right. The computing device and controls may also control the boom 110 to move up (boom-up) and move down (boom-down). These six directions (tele-out; tele-in; boom-up; boom-down; swing left; and swing right) may each be represented by a vector, each of which may be processed and tracked using appropriate algorithms as will be explained. Impact with obstacles on a worksite may be avoided by conducting vector analysis and continual monitoring of the orientation of the boom 110.

Figure 2:
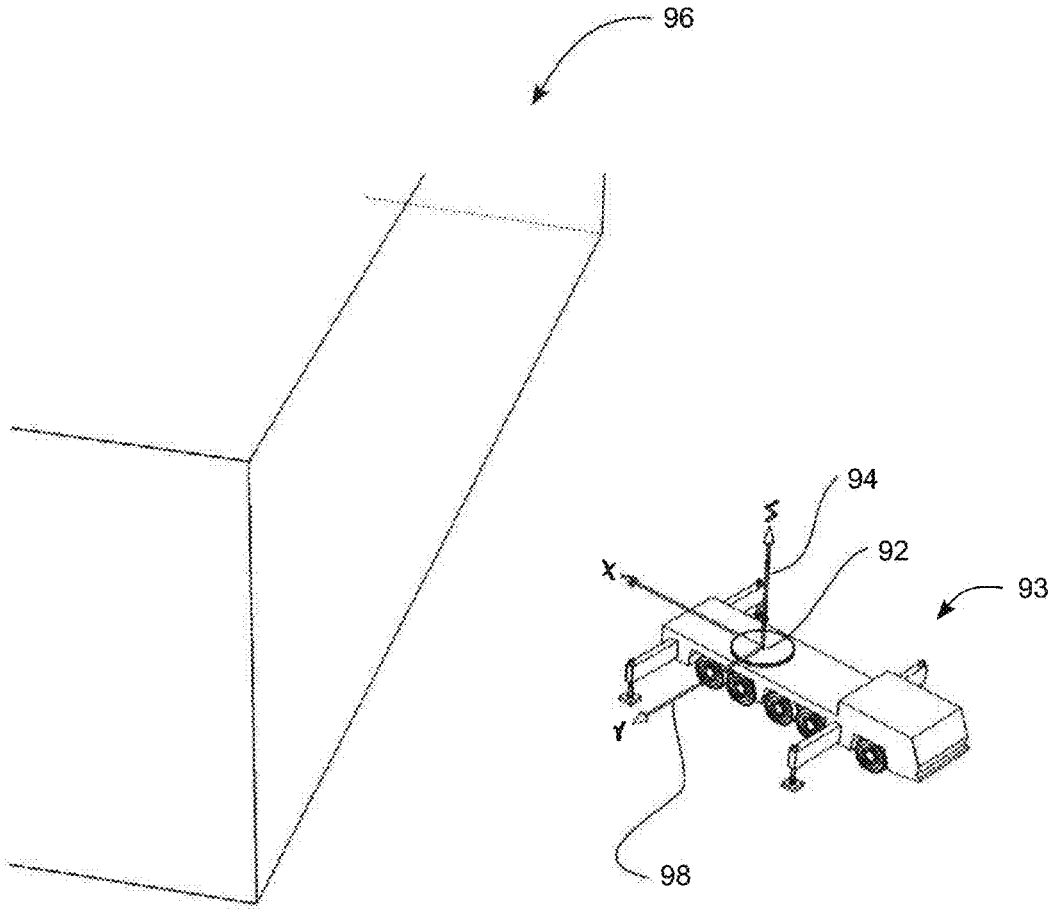
FIG. 2 is a schematic view of a forbidden volume and a coordinate system of a crane.

FIG. 2 is a perspective view of a schematic of the lower works 93 of a telescopic crane 90 and an outline 96 of the building 80 under construction. A coordinate system 98 is shown having an origin 92 at a base of the axis of rotation 94 of a rotating bed. In the embodiments that follow, the coordinate system will be fixed relative to the lower works 93 of the telescopic crane 90. However, in other embodiments the coordinate system could be fixed relative to the rotating bed such that the X axis would remain constant along the telescoping boom. Other coordinate systems are possible and could be based on any origin within the construction zone.

Figure 3:
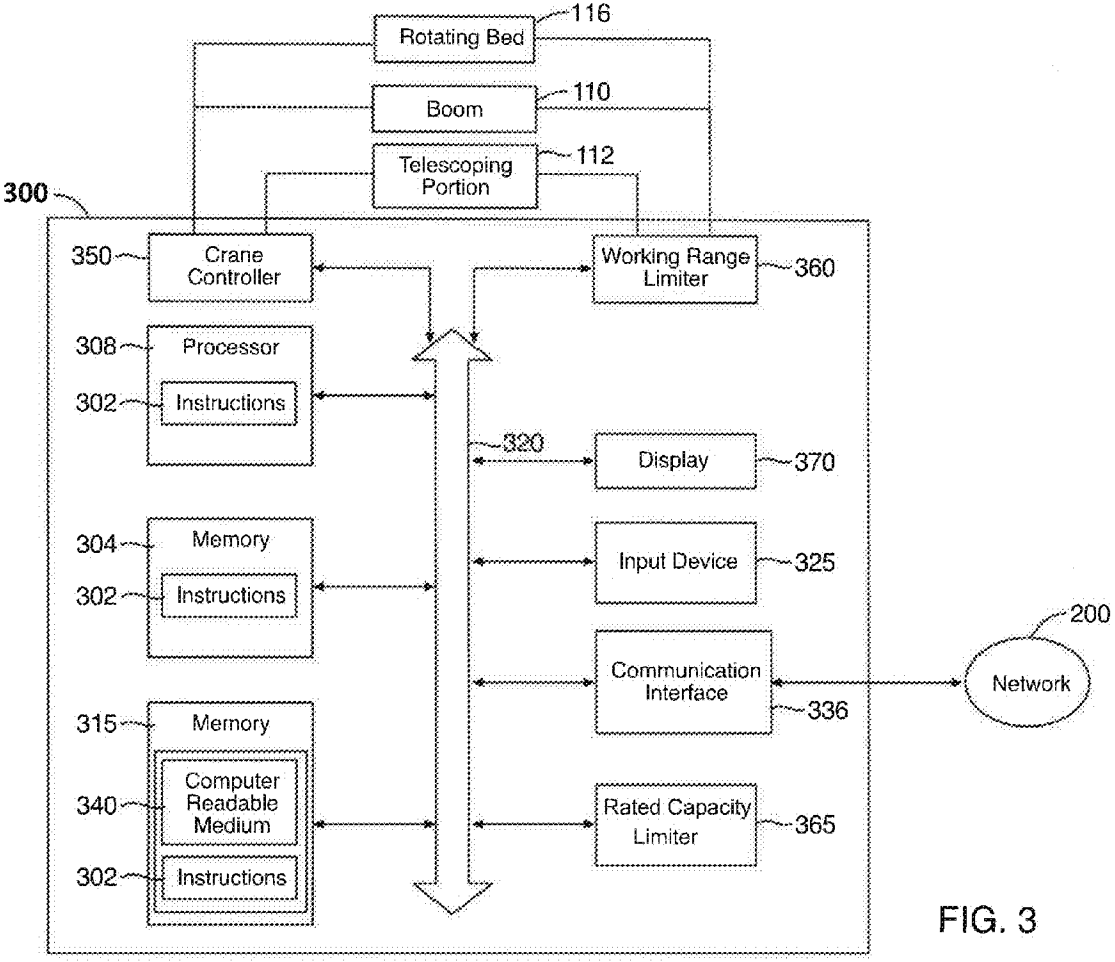
FIG. 3 illustrates a computer system, which may represent any of the computing devices referenced herein or that may execute the methods or logic of the present disclosure.

FIG. 3 illustrates a computer system 300 (or other computing device), which may represent a cab computing device 300 or a wireless network computer, or any other computing device referenced herein or that may be used to execute the disclosed methods or logic disclosed. The computer system 300 may include an ordered listing or a set of instructions 302 that may be executed to cause the computer system 300 to perform any one or more of the methods or computer-based functions disclosed herein. The computer system 300 may operate as a stand-alone device or may be connected, e.g., using a network 200, to other computer systems or peripheral devices, for example.

In a networked deployment, the computer system 300 may operate in the capacity of a server or as a client-user computer in a server-client user network environment, or as a peer computer system in a peer-to-peer (or distributed) network environment. The computer system 300 may also be implemented as or incorporated into various devices, such as a personal computer or a mobile computing device capable of executing a set of instructions 302 that specify actions to be taken by that machine, including and not limited to, execution of certain applications, programs, and with the option of accessing the Internet or Web through any form of browser. Further, each of the systems described may include any collection of sub-systems that individually or jointly execute a set, or multiple sets, of instructions to perform one or more computer functions.

The computer system 300 may include a memory 304 on a bus 320 for communicating information. Code operable to cause the computer system to perform any of the acts or operations described herein may be stored in the memory 304. The memory 304 may be a random-access memory, read-only memory, programmable memory, hard disk drive or any other type of volatile or non-volatile memory or storage device.

The computer system 300 may include a processor 308, such as a central processing unit (CPU) and/or a graphics-processing unit (GPU). The processor 308 may include one or more general processors, digital signal processors, application specific integrated circuits, field programmable gate arrays, digital circuits, optical circuits, analog circuits, combinations thereof, or other now known or later-developed devices for analyzing and processing data. The processor 308 may implement the set of instructions 302 or other software program, such as manually programmed or computer-generated code for implementing logical functions. The logical function or any system element described may, among other functions, process and/or convert an analog data source such as an analog electrical, audio, or video signal, or a combination thereof, to a digital data source for audio-visual purposes or other digital processing purposes such as for compatibility of computer processing.

The computer system 300 may also include a disk or optical drive unit 315. The disk drive unit 315 may include a computer-readable medium 340 in which one or more sets of instructions 302, e.g., software, can be embedded. Further, the instructions 302 may perform one or more of the operations as described herein. The instructions 302 may reside completely, or at least partially, within the memory 304 and/or within the processor 308 during execution by the computer system 300. One or more databases in memory may store a Cartesian coordinate system, and may relate positions of obstacles and the boom a crane to each other in 3D space within the database.

The memory 304 and the processor 308 also may include computer-readable media as discussed above. A "computer-readable medium," "computer-readable storage medium," "machine readable medium," "propagated-signal medium," and/or "signal-bearing medium" may include any device that includes, stores, communicates, propagates, or transports software for use by or in connection with an instruction executable system, apparatus, or device. The machine-readable medium may selectively be, but not limited to, an electronic, magnetic, optical, electromagnetic, infrared, or semiconductor system, apparatus, device, or propagation medium.

The computer system 300 may further include a crane controller 350, a working range limiter 360, and a rated capacity limiter 365. The crane controller 350 may be coupled with the processor 308 and the bus 320 and be configured to control components of the crane, including the boom 110 and the rotating bed 116, in response to receiving control signals from the processor 308.

The rated capacity limiter 365 (also referred to as a moment limiter in the art) provides information for crane operators to ensure that the crane devices work safely in the range of design parameters. The working range limiter 360 provides information for crane operators to ensure that the crane devices work safely outside of a restricted volume. The working range limiter 360 and the rated capacity limiter 365 may each monitor the operations of the crane through a plurality of sensors, and provide information regarding the limits of the cranes to an operator. In some embodiments the functionality of the working range limiter 360 and the rated capacity limiter 365 may be combined into a single unit. When the crane 90 lifts objects, the reading changes continuously with the operation of the crane 90. The sensors provide information on the length and angle of the crane boom 110, the lifting height and range, the rated load, the lifted load and so on. If the crane 90 works nearly beyond the permitted scope, the rated capacity limiter 365 and/or the working range limiter 360 may sound an alarm, may light an indicator, or modify the operation of the crane. In some embodiments, the working range limiter 360 may also be adapted to act as a controller of the boom 110, the telescoping portion 112, and the rotating body 116 to allow the crane 90 to continue operation while avoiding the restricted volume.

Additionally, the computer system 300 may include an input device 325, such as a keyboard and/or mouse, configured for a user to interact with any of the components of the computer system 300. It may further include a display 370, such as a liquid crystal display (LCD), a cathode ray tube (CRT), or any other display suitable for conveying information. The display 370 may act as an interface for the user to see the functioning of the processor 308, or specifically as an interface with the software stored in the memory 304 or the drive unit 315.

The computer system 300 may include a communication interface 336 that enables communications via the communications network 200. The network 200 may include wired networks, wireless networks, or combinations thereof. The communication interface 336 network may enable communications via any number of communication standards, such as 802.11, 802.17, 802.20, WiMax, cellular telephone standards, or other communication standards.

Accordingly, the method and system may be realized in hardware, software, or a combination of hardware and software. The method and system may be realized in a centralized fashion in at least one computer system or in a distributed fashion where different elements are spread across several interconnected computer systems. A typical combination of hardware and software may be a general-purpose computer system with a computer program that, when being loaded and executed, controls the computer system such that it carries out the methods described herein. Such a programmed computer may be considered a special-purpose computer, and be specially adapted for placement within the cab 120 and control of the crane 90.

The method and system may also be embedded in a computer program product, which includes all the features enabling the implementation of the operations described herein and which, when loaded in a computer system, is able to carry out these operations. Computer program in the present context means any expression, in any language, code or notation, of a set of instructions intended to cause a system having an information processing capability to perform a particular function, either directly or after either or both of the following: a) conversion to another language, code or notation; b) reproduction in a different material form.

The order of the steps or actions of the methods described in connection with the disclosed embodiments may be changed as would be apparent to those skilled in the art. Thus, any order appearing in the Figures or described with reference to the Figures or in the Detailed Description is for illustrative purposes only and is not meant to imply a required order, except where explicitly required.

Figure 9:
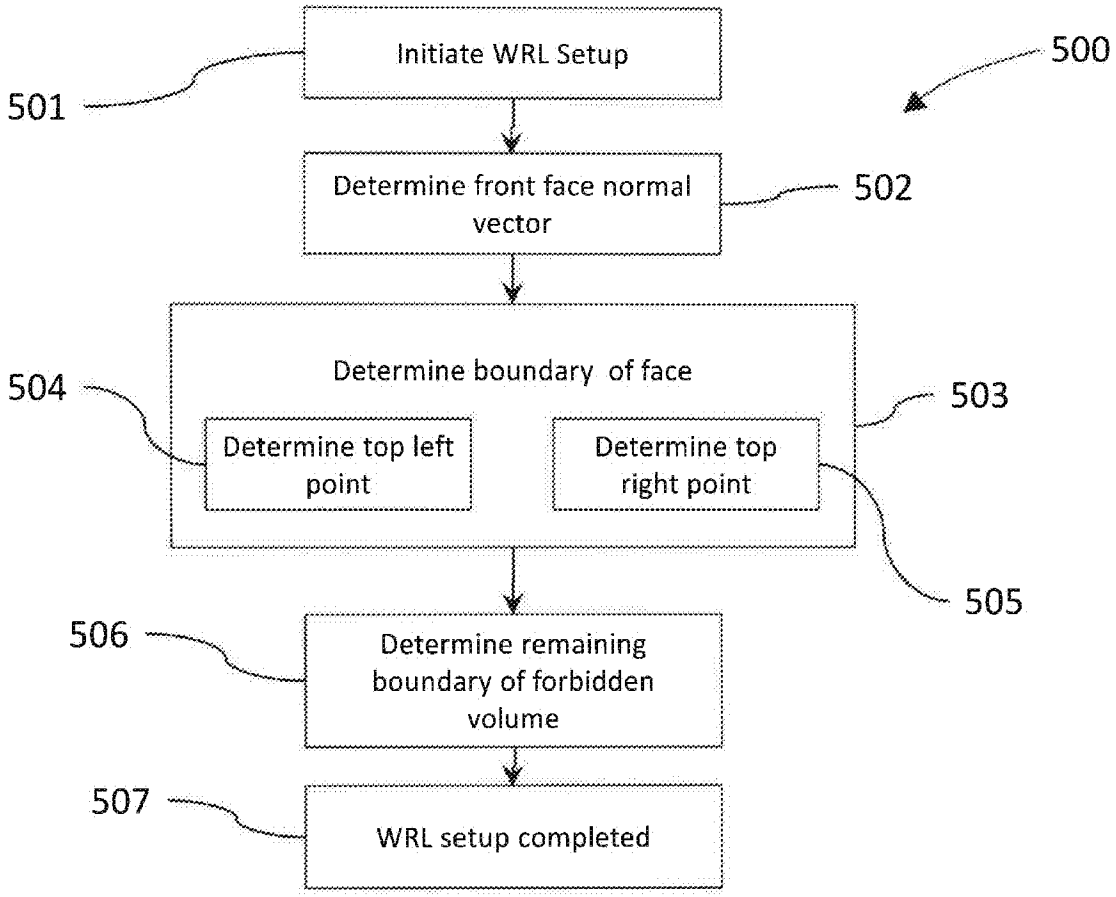
FIG. 9 is a flow chart of a method for setting up a crane control system.
Figure 10:
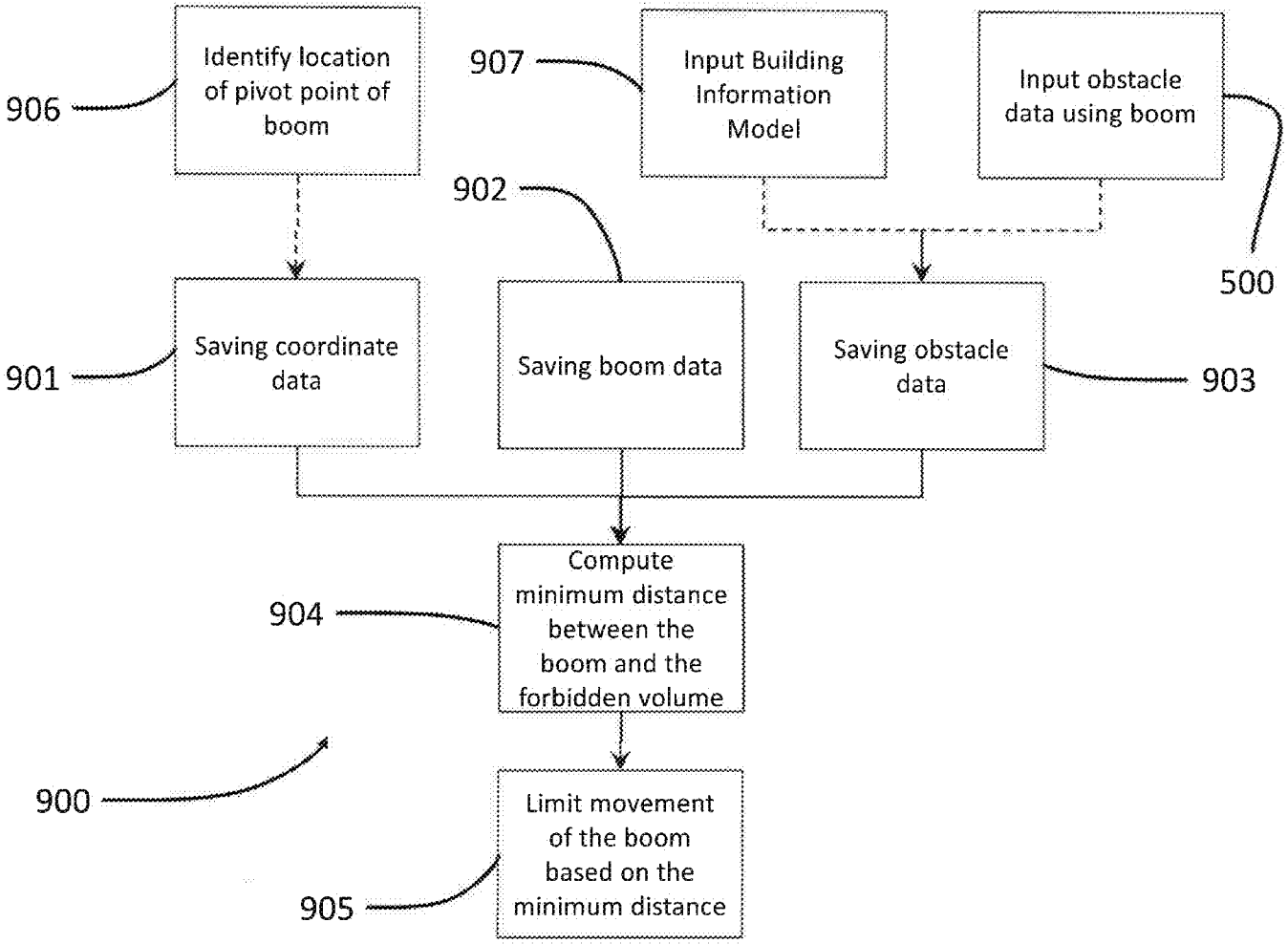
FIG. 10 is a flow chart of a method for limiting the operation of a boom.

FIG. 9 provides a high level flow chart of a method 500 for setting up a WRL for a crane and FIG. 10 illustrates a high level flow chart of a method 900 for altering crane functions during crane use. The method will be described in relation to FIG. 4 and FIG. 5. The method for setting up a WRL for a crane begins at step 501 in which the WRL setup process is initiated. This may be done by a crane operator or other personnel. The process may be done manually, it may be an automated process, or a combination of manual and automated.

Figure 4:
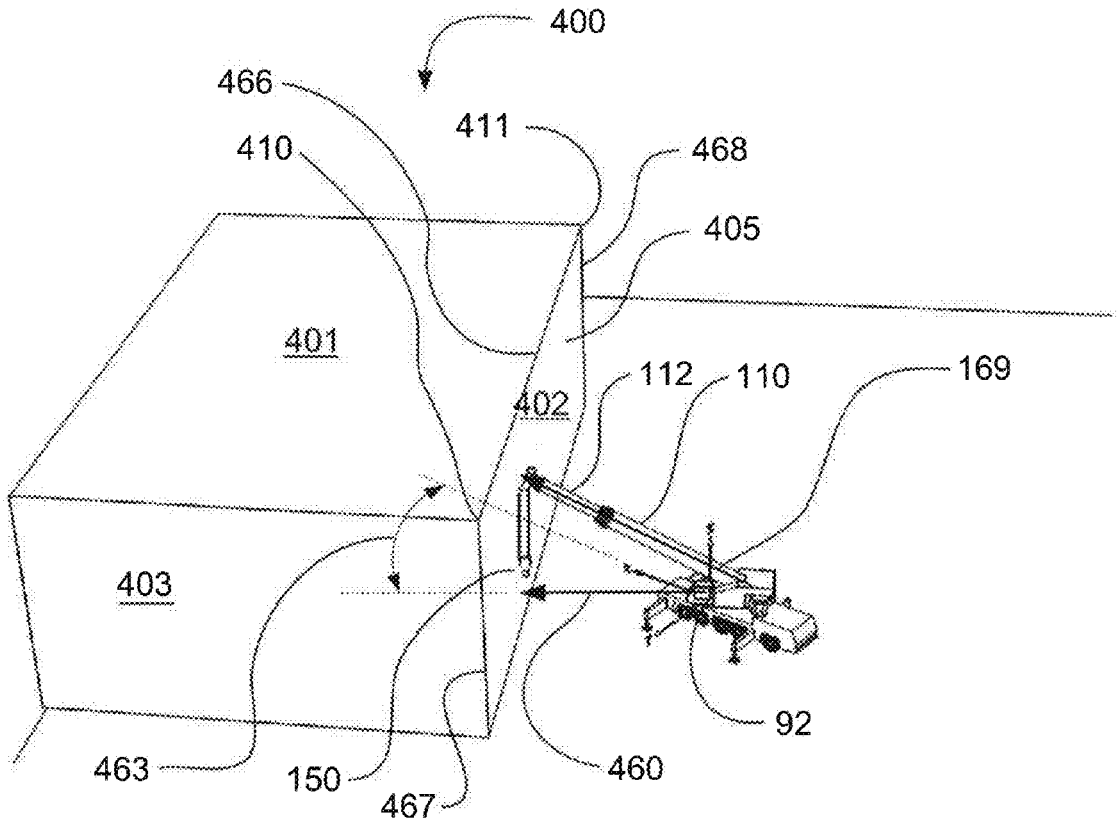
FIG. 4 is a perspective view of a forbidden volume and a crane.

FIG. 4 illustrates a three-dimensional model of a forbidden volume 400 corresponding to the outline 96 of building 80. The process of setting up the WRL defines the forbidden volume 400 in relation to the crane. The forbidden volume 400 may correspond to other obstacles or volumes in which crane operation is not permitted. In the example of the rectangular forbidden volume 400 of FIG. 4, the boundaries of the forbidden volume 400 are defined by four rectangular planar faces. A first plane 401 would be above the forbidden volume 400. A second plane 402 would be facing the crane. A third plane 403 would be to the left of the forbidden volume (as seen by the crane). The fourth plane 404 would be to the right of the forbidden volume (behind plane 401 and not visible in the figure). This forbidden volume 400 is referred to as a quasi-volume since an actual rectangular solid would have 6 faces; the face at ground level of the forbidden volume 400 and the face at the back of the forbidden volume 400 (as seen from the crane) are not considered relevant and may be ignored.

The definition of the quasi-volume can begin with the plane 402 that contains the front rectangular face 405. To define this plane 402, in block 502, a vector normal to the face 405 is found, as well as a point contained within the plane 402. Both of these can be provided by the definition of a vector 460 that points from the origin 92 of the coordinate system 98 to the forbidden volume 400 that is normal to the front rectangular face 405. This vector 460 is referred to as $\vec{R}_{Bldg}$.

The direction of vector 460 is found by swinging the rotating bed 116 of the crane to point the boom 110 towards the forbidden volume 400, and recording the swing angle 463 which is referred to as $\alpha_{Bldg}$. The magnitude of vector 460 (the vector endpoint providing a point contained within the plane 402) is created by extending the telescopic boom 110 to have the tip of the telescopic boom 110, where the hook block is located, at the distance desired for the creating quasi-volume front face 405, and recording the current hook radius (which is a common element measured by a crane control system). For this step the hook block can be at any desired height.

Note that the preferred embodiment is not expected to have the quasi-volume be coincident with the actual building object. The quasi-volume would be expected to have some buffer or distance away from the building object. The positioning of the hook block is actually indicating the buffer desired. In another embodiment, if the actual building object location was desired for the quasi-volume, a manual measurement could be taken from the hook block to the actual building, and this value manually entered to the programming to be added to the $\vec{R}_{Bldg}$ magnitude. Manual measurement may be necessary to prevent accidental impact between the boom 110 and the object. Also note that the vector, $\vec{R}_{Bldg}$ 460 is in the XY plane of the coordinate system 98; therefore, the boom up/down angle is not relevant. The crane operator may use his normal view of the building object to point the boom 110 at the object. While it is preferable that the vector $\vec{R}_{Bldg}$ 460 be perpendicular to the face 405, the swing angle 463, $\alpha_{Bldg}$, may be off from the true perpendicular direction without introducing large errors. If the swing angle 463 is off by 5 degrees in either direction, it will only introduce a 0.4% error in radial distance for the vector 460, $\vec{R}_{Bldg}$.

With the front face plane 402 defined by vector, $\vec{R}_{Bldg}$ 460, the boundary of the face 405 may be determined in block 503. The boundary of the face 405 may be defined by two locations, the left top point 410 and the right top point 411 for the quasi-volume. The locations are determined by pointing the boom 110 at each location 410, 411 on the actual building object and recording the swing angle and the boom angle. For other building shapes, other points may be used.

Figure 5:
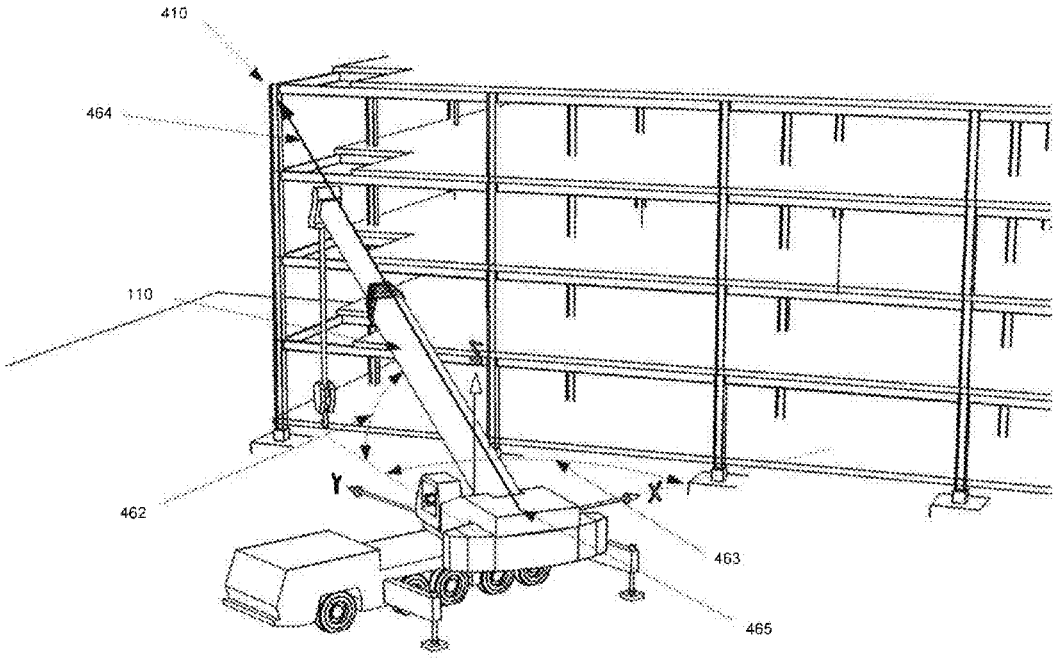
FIG. 5 is a perspective view of a building and a crane determining the location of the upper left point of a building.

FIG. 5 illustrates an example of determining the position of the top left location 410, as done in block 504. With the boom pointed at this location 410, the swing angle 463 is recorded as $\alpha_{Left}$ and the boom angle 462 is recorded as $\beta_{Left}$. These angles, along with the position of the boom pivot point 465, which is known within the coordinate system 98, are used to create a direction vector, $\hat{r}_{Left}$ 464. The length of the boom 110 and the position of the hook block 150 may be at any value and are not important at this time. The left top point 410 may now be determined by intersecting the direction vector 464 $\hat{r}_{Left}$ and the plane for the front face 402 to obtain the location of the left top point 410 $\vec{R}_{Left}$.

In block 505, a similar procedure is used for the other top location 411 by intersecting a similar direction vector, $\hat{r}_{Right}$ from pointing the boom 110 to the top right location 411 and intersecting the direction vector $\hat{r}_{Right}$ with the plane for the front face 402 to obtain the location of the right top point $\vec{R}_{Right}$.

The front top edge 466 is now defined by these two points, and can be modeled as $\vec{R}_{FrontTop}=\vec{R}_{Right}-\vec{R}_{Left}$. A direction unit vector for the front top edge is $$\hat{r}_{FrontTop} = \frac{\vec{R}_{FrontTop}}{|\vec{R}_{FrontTop}|}.$$

A direction unit vector for the normal to the front face 405 is $$\hat{r}_{Bldg} = \frac{\vec{R}_{Bldg}}{|\vec{R}_{Bldg}|}.$$

A direction unit vector for the left edge 467 and right edge 468 of the front face, pointing from the top points 410 and 411 to the ground is $\hat{r}_{Down}=-\hat{k}$, where $\hat{k}$ is the unit vector for the vertical direction and is aligned with the Z axis of the coordinate system 98.

The extent of the left edge 467 and the right edge 468, can be any value that is sufficient to cover the height of the building or forbidden zone; the bottom edge of the quasi-volume is not relevant to the crane operation, so the distance can extend into the ground; for instance, it might be set to 500 meters. This extent can be applied to the direction vector $\hat{r}_{Down}$ to arrive at points for the remaining vertices of the front face 402.

In block 506, the remainder of the forbidden zone is determined. For the top face 401, the left top location point 410 and the right top location point 411 already define two of the points on the top face 401. The $\hat{r}_{Bldg}$ direction vector 460 is used to set the other two points for the top face. As with the front face 402, any value for the extent of the face can be used that is sufficient to cover the reach of the crane; again, it might be set to 500 meters. Telescopic booms are often used to position a load on top of the building object, and not beyond it, so this extent is not considered critical.

For the left face 403, as well as the right face 404, the left top location point and the left lower location point already define two of the points on the face. The $\hat{r}_{Bldg}$ direction vector is used to set the other two points for the face. As with the top face, any value for the extent of the face can be used that is sufficient to cover the reach of the crane; again, it might be set to 500 meters. In block 507 the WRL setup is completed.

Figure 6:
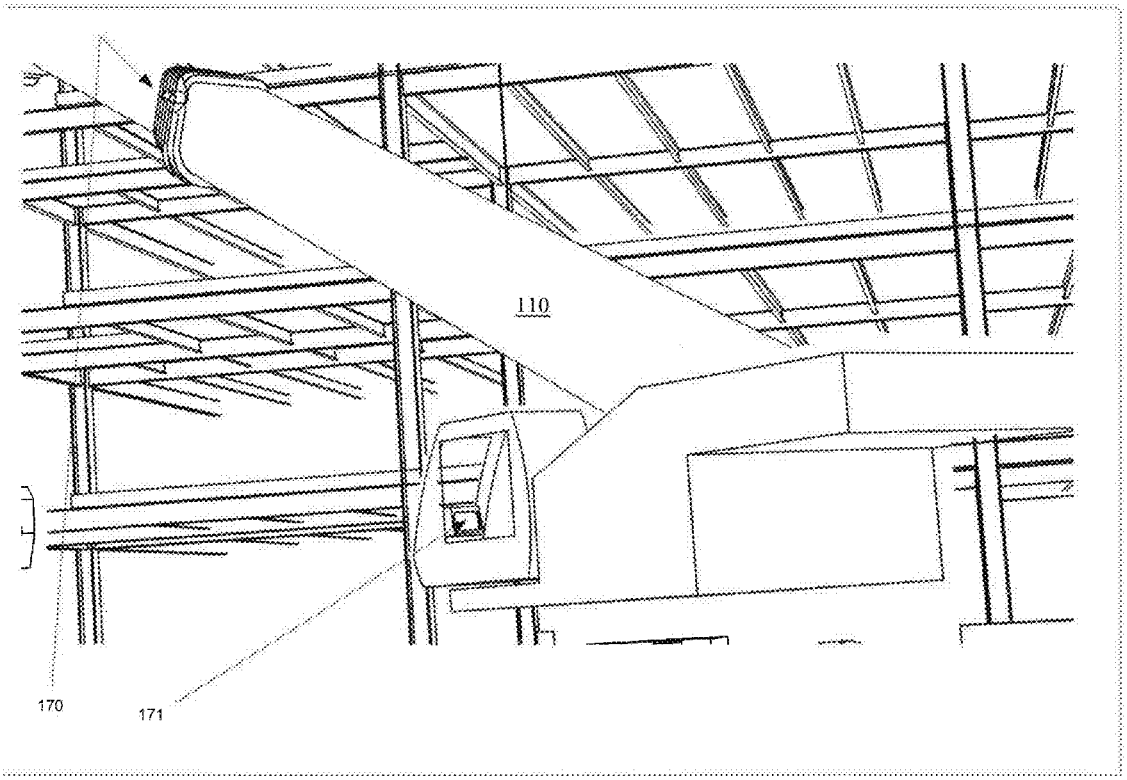
FIG. 6 is a perspective view of a boom having an electronic assist device for aiming the boom.
Figure 7:
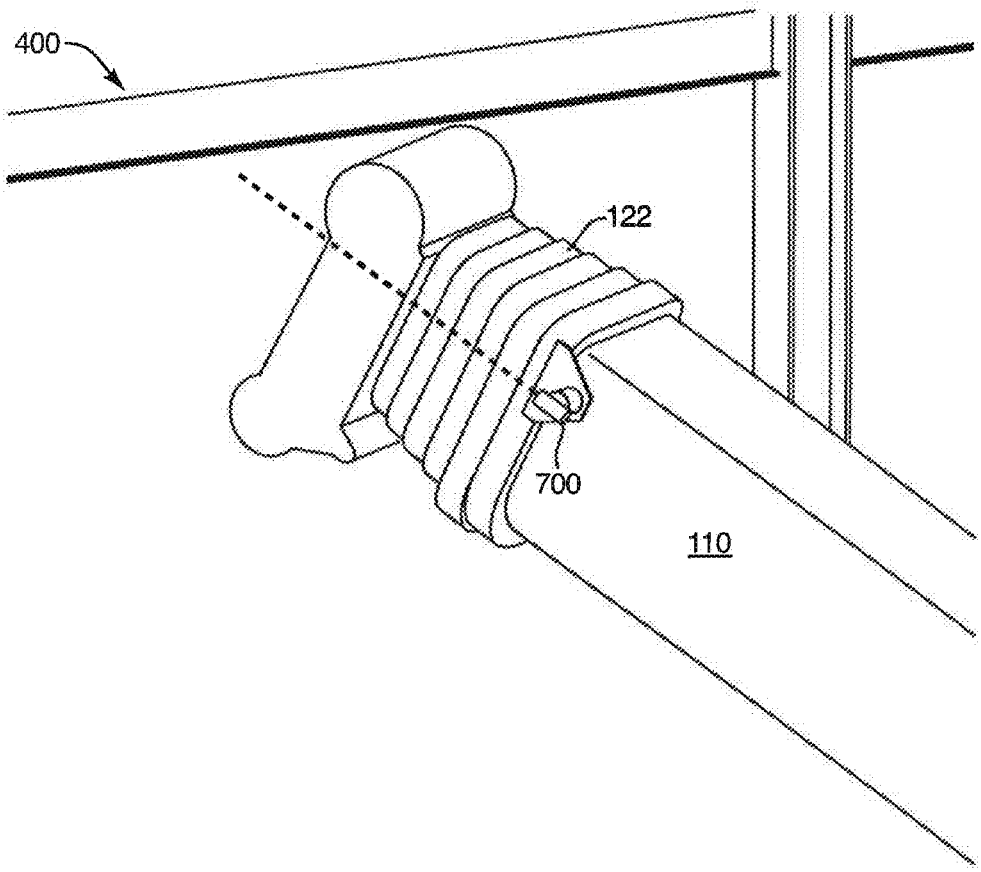
FIG. 7 is a perspective view of a boom having an electronic assist device for aiming the boom.

As shown in FIG. 6, the positioning of the boom 110 to point the boom 110 at the locations may be enhanced by manual or electronic assistance. For manual assistance, ground personnel might be positioned behind the crane as the boom 110 is pointed, and the ground personnel could indicate to the crane operator when the boom is properly oriented. Preferred embodiments would be electronic assistance in the form of a video camera system. The camera 170 would be aligned with the non-telescopic base section of the boom 110. A crane operator video display 171 would show the orientation of the boom 110 to point at the critical locations. Note that the deflection or sagging of the telescopic boom 110 would not affect the point locations since the modeling is based on the orientation of the base section (the boom angle and swing angle).

In another embodiment, the positioning of the boom may be enhanced using a pointing device 700 on a base section of the boom 110. For example, the pointing device 700 may identify a location (and thus boom and swing angles) such as the top left or top right corner of the forbidden volume. This information may be recorded by the computer system 300, and may be combined with a distance determined between the end of the boom 110 (where a crane hook 150 naturally hangs down). The pointing device 700 may be a camera, a laser, or other pointing device for lining up with a determined threshold of accuracy the boom with the outer boundaries of the obstacle 400. In some embodiments, the pointing device 700 may further contain a distance measurement device such as a laser rangefinder to determine a distance between the location and the end of the boom. The distance between the end of the boom and the location may then be converted into a distance in the XY plane.

The distance between the end of the crane 90 (or from the crane hook 150) and the forbidden volume 400 may be determined manually or with a computing device. The distance may be based on a minimum distance from a centerline-of-rotation of the boom with respect to the obstacle 400, e.g., from the hook 150 a distance taken perpendicularly to a middle section of the obstacle.

With the forbidden quasi-volume now defined within the coordinate system, and considering that the boom is also represented as a known vector (169) within the coordinate system, the invention can provide appropriate alterations of the control system to avoid undesirable interactions between the boom and the jobsite object using the method 900 of FIG. 10.

In block 901 coordinate data is saved to memory. The coordinate data provides a reference for orientating the crane and its special relationship to objects around it. One example of saving coordinate data includes identifying the location of the pivot point of the boom as shown in block 906. In block 902, boom data is saved to memory. The boom data may be the known vector 169 and may be determined automatically by the crane control system. In block 903, obstacle data is saved to memory. The obstacle data may be saved to memory using the method 500 shown in FIG. 9. In some embodiments, a building information model (BIM) may loaded into memory as shown in block 907.

The boom is modeled as known vector 169 and the vector data is saved to memory during operation of the crane. The distance from the boom to the quasi-volume features (such as faces and edges) is computed in block 904. The known vector for the boom is referred to as $\vec{R}_{Boom}$. This is used to compute a direction unit vector as follows:

$$\hat{r}_{Boom} = \frac{\vec{R}_{Boom}}{|\vec{R}_{Boom}|}.$$

Figure 8:
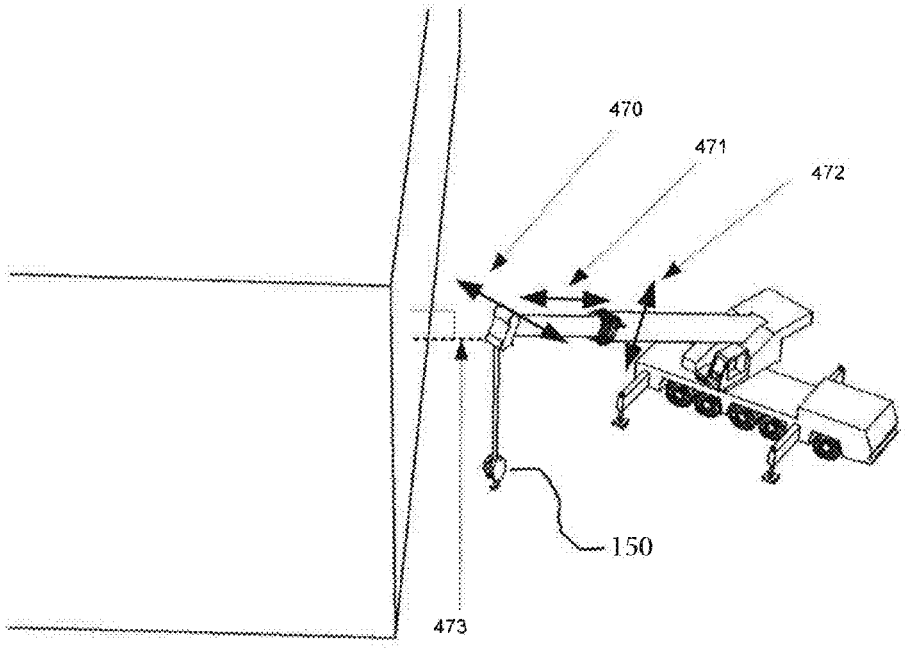
FIG. 8 is a perspective view of a forbidden volume and a crane showing a proximity vector between the boom and the forbidden volume.

This distance is the basis for a critical proximity vector 473, which is the minimum distance between a point on the boom and the forbidden volume. With the boom modeled as a known vector 169, vectors may be computed for crane function motions. The first motion is the telescoping motion 471, the second motion is swinging left and right 470, and the third motion is boom up/down 472. For each motion there is a direction, and they are represented by six unit vectors within the coordinate system as follows: Telescope out: $\hat{t}_{TO}$, Telescope in: $\hat{t}_{TI}$, Swing left: $\hat{t}_{SL}$, Swing right: $\hat{t}_{SR}$, Boom up: $\hat{t}_{BU}$, and Boom down: $\hat{t}_{BD}$. The telescope out unit vector is coincident with the boom vector 169 and is computed as $\hat{t}_{TO}=\hat{r}_{Boom}$. The telescope in unit vector is $\hat{t}_{TI}=-1\cdot\hat{t}_{TO}$. The swing left direction vector is computed as $\vec{T}_{SL}=\hat{k}\times\hat{t}_{TO}$, the swing left unit vector is computed as $$\hat{t}_{SL} = \frac{\vec{T}_{SL}}{|\vec{T}_{SL}|},$$

and the swing right unit vector is $\hat{t}_{SR}=-1\cdot\hat{t}_{SL}$. The boom up unit vector is computed as $\hat{t}_{BU}=\hat{t}_{TO}\times t_{SL}$ and the boom down unit vector is $\hat{t}_{BD}=-1\cdot\hat{t}_{BU}$. The critical proximity vector 473 starts at the nearest point on the boom, and this point may be along the length of the boom (and not at the end of the boom). FIG. 8 illustrates a critical proximity vector 473 from the end of the boom to the front face of the quasi-volume. The critical proximity vector 473 $\vec{T}_{Prox}$ is converted to a direction unit vector as follows:

$$\hat{t}_{Prox} = \frac{\vec{T}_{Prox}}{|\vec{T}_{Prox}|}.$$

In block 905, a scale factor for each crane function is determined for alterations of the control system. A value of 1.0 for a particular scale factor would indicate the crane function would be unaltered. A value of 0.0 for a particular scale factor would indicate the crane function would be shutdown. A value of 0.5 for a particular scale factor would indicate the crane function would be slowed by 50 percent.

The scale factors correspond to the six crane functions as follows: Telescope out: $f_{TO}$; Telescope in: $f_{TI}$; Swing left: $f_{SL}$; Swing right: $f_{SR}$; Boom up: $f_{BU}$; and Boom down: $f_{BD}$.

The value for the scale factor may be based on two thresholds for the critical proximity distance 473. The critical proximity distance is $d_{Prox}=|\vec{T}_{Prox}|$. As the crane boom approaches the quasi-volume, this critical proximity distance decreases. When the critical proximity distance reaches a slowdown threshold ($\delta_1$), the crane function will begin to slow down. When the critical proximity distance reaches a shutdown threshold ($\delta_0$), the crane function will stop. These thresholds may be universal for the crane (applied to all crane functions), or the thresholds may be specific to each function. Considering the drift that is typical when stopping crane swing motions, particular threshold values for the swing function would be expected. However, the preferred embodiment described here will use a universal value for simplicity.

The critical proximity distance and the thresholds are used to create a scaling of the crane function based on the degree to which the proximity distance is between the thresholds as follows:

$$\varepsilon_{Prox} = \frac{\delta_1 - d_{Prox}}{\delta_1 - \delta_0}.$$

This relationship may be applied if the critical proximity distance has "entered" the threshold "zone". Otherwise, the crane functions would not be altered and the scale factors would be set to 1.0.

The degree to which each crane function may require alteration within the threshold zone may be based on the position of the boom. The degree of alteration may be based on taking the dot product of the critical proximity unit vector and the earlier computed crane motion direction unit vectors. If the crane boom is swinging left toward a wall on the left, the critical proximity vector will be pointing to the left (from the boom to the wall), and the swing left motion vector will likewise be pointing to the left. The dot product in this case will be relatively close to 1, and would indicate that the swing left function should be directly altered. However, the swing right direction will be a unit vector pointing to the right; and the dot product in this case (still with respect to the critical proximity vector pointing to the left) will be relatively close to −1. The following computations determine the crane function alteration factors (one for each function direction):

$$\epsilon_{TO}=\hat{t}_{TO}\cdot\hat{t}_{Prox}$$

$$\epsilon_{TI}=\hat{t}_{TI}\cdot\hat{t}_{Prox}$$

$$\epsilon_{SL}=\hat{t}_{SL}\cdot\hat{t}_{Prox}$$

$$\epsilon_{SR}=\hat{t}_{SR}\cdot\hat{t}_{Prox}$$

$$\epsilon_{BU}=\hat{t}_{BU}\cdot\hat{t}_{Prox}$$

$$\epsilon_{BD}=\hat{t}_{BD}\cdot\hat{t}_{Prox}$$

The process of determining the crane function scale factors is now described. Initially the crane function scale factors may be set to 1.0. Each crane function direction may then be evaluated. If the critical proximity distance is between the crane function thresholds, and the direction dot product indicates that the crane function direction should be altered, then the scale factor may be computed as one of the following (depending on the crane function direction being evaluated):

$$f_{TO}=1-\epsilon_{Prox}\cdot\epsilon_{TO}$$

$$f_{TI}=1-\epsilon_{Prox}\cdot\epsilon_{TI}$$

$$f_{SL}=1-\epsilon_{Prox}\cdot\epsilon_{SL}$$

$$f_{SR}=1-\epsilon_{Prox}\cdot\epsilon_{SR}$$

$$f_{BU}=1-\epsilon_{Prox}\cdot\epsilon_{BU}$$

$$f_{BD}=1-\epsilon_{Prox}\cdot\epsilon_{BD}$$

If the direction dot product indicates that a crane function direction should be altered, and the critical proximity distance is at or beyond the shutdown threshold, the crane function scale factor would be set to 0.0.

In another example, there may be a building information model (BIM) of the obstacle (such as a building, or other non-rectangular-shaped object), then the BIM may be incorporated into the crane 3D workspace when there are at least two points available with which to align the BIM within the coordinate system.

It should be understood that various changes and modifications to the presently preferred embodiments described herein will be apparent to those skilled in the art. For example, the obstacles can be of any kind, not just rectangular or related to a structure under construction. For example, the forbidden volume could contain a power line as a natural obstacle for which the computer system 300 may monitor and with which to avoid collision, all the while avoiding collision with the forbidden volume. Such changes and modifications can be made without departing from the spirit and scope of the present embodiments and without diminishing its intended advantages. It is therefore intended that such changes and modifications be covered by the appended claims.

The invention claimed is:

1. A method for controlling a boom of a crane in proximity of obstacles at a worksite, the crane comprising a lower works and a rotating bed on which the boom is mounted, the method executable by a computing device having a processor and memory, comprising:

a) saving, in the memory, coordinate data representing a coordinate system at the worksite having an origin at a base of an axis of rotation of the rotating bed and fixed relative to the lower works;

b) saving, in the memory, obstacle data representing a forbidden volume in the coordinate system;

c) saving, in the memory, boom data representing the location of the boom; and d) limiting movement of the boom, by the computing device, to avoid the boom entering the forbidden volume, the limiting based on a computed minimum distance between the boom and the forbidden volume using the coordinate data, the obstacle data, and the boom data.

2. The method of claim 1, wherein saving obstacle data comprises inputting data representing the forbidden volume.

3. The method of claim 2, wherein the data representing the forbidden volume comprises a building information model, and saving obstacle data comprises aligning the building information model in the coordinate system.

4. The method of claim 1, wherein the boom rotates relative to the crane about a central axis, wherein the saving coordinate data comprises saving data representing the central axis.

5. The method of claim 1, wherein saving obstacle data comprises using the boom to identify at least two coordinates of the forbidden volume.

6. The method of claim 5, wherein the forbidden volume is a rectangular prism and the at least two coordinates comprise the front, top left corner of the forbidden volume and the front, top right corner of the forbidden volume.

7. The method of claim 6, wherein the rotating bed is rotatable relative to the lower works about the axis of rotation, and wherein using the boom to identify at least two coordinates of the forbidden volume comprises:

i) aiming the boom in a first direction at a front face of the forbidden volume and determining a horizontal distance between the face and the axis of rotation to determine a first vector corresponding to the front face of the forbidden volume;

ii) aiming the boom in a second direction at a front, top left corner of the forbidden volume and determining a second vector corresponding to the second direction of the boom;

iii) intersecting the second vector and the plane to define a first coordinate of the obstacle data;

iv) aiming the boom in a third direction at a front, top right corner of the forbidden volume and determining a third vector corresponding to the third direction of the boom; and v) intersecting the third vector and the plane to define a second coordinate of the obstacle data.

8. The method of claim 7, wherein aiming the boom comprises at least one of aligning the boom using a video camera attached to the boom and aligning the boom using a laser pointer attached to the boom.

9. The method of claim 7, wherein determining a horizontal distance between the face and the axis of rotation comprises measuring a distance from the axis of rotation to the face.

10. The method of claim 1 wherein limiting movement of the boom comprises:

i) establishing a slowdown threshold distance between the boom and the forbidden volume; and ii) changing a crane function responsive to the computed minimum distance between the boom and the forbidden volume being less than the threshold distance.

11. The method of claim 10, wherein changing the crane function comprises slowing down the movement of the boom in at least one direction that moves the boom closer to the forbidden volume.

12. The method of claim 10, wherein limiting movement of the boom further comprises:

i) establishing a shutdown threshold distance between the boom and the forbidden volume; and ii) stopping the movement of the boom in response to the computed minimum distance between the boom and the forbidden volume being less than the shutdown threshold distance.

13. The method of claim 10, wherein the crane function is selected from the group consisting of telescoping in, telescoping out, booming up, booming down, swinging left, and swinging right.

14. The method of claim 1, wherein determining a horizontal distance between the face and the axis of rotation comprises placing a hook of the crane proximate the forbidden volume; and using a rated capacity indicator (RCL) hook radius to determine the horizontal distance.

15. A method for controlling a boom of a crane in proximity of obstacles at a worksite, the method executable by a computing device having a processor and memory, comprising:

a) saving, in the memory, coordinate data representing a coordinate system at the worksite;

b) saving, in the memory, obstacle data representing a forbidden volume in the coordinate system;

c) saving, in the memory, boom data representing the location of the boom;

d) limiting movement of the boom, by the computing device, to avoid the boom entering the forbidden volume, the limiting based on a computed minimum distance between the boom and the forbidden volume using the coordinate data, the obstacle data, and the boom data; and e) computing, with the computing device, a maximum swing angle of the boom, a maximum extension of the boom, a maximum boom-up, and a maximum boom-down of the boom.

16. A system for controlling a boom of a crane in proximity of obstacles at a worksite, the crane comprising a lower works and a rotatable bed to which the boom is mounted, the system comprising:

a) a crane control system configured to control operation of the crane boom;

b) a processor in operable communication with the crane control system; and c) memory in operable communication with the processor, the memory storing data comprising:

i) data representing a coordinate system having an origin at a base of an axis of rotation of the rotating bed and fixed relative to the lower works;

ii) data representing the crane boom;

iii) data representing a forbidden volume; and iv) computer executable instructions for execution by the processor, the computer executable instruction configured to calculate a minimum distance between the crane boom and the forbidden volume based on the data representing the crane boom and the data representing the forbidden volume, and to cause the crane control system to limit movement of the boom based on the calculated minimum distance.

17. The system of claim 16, wherein the computer executable instructions are further configured to determine at least two coordinates of the forbidden volume using the boom.

18. The system of claim 17 further comprising a boom aiming system for aiming the boom at the at least two coordinates of the forbidden volume.

19. The system of claim 18 wherein the boom aiming system comprises a system selected from the group consisting of a laser pointer and a video camera system.

20. The system of claim 16, wherein the data representing the forbidden volume comprises a building information model, and wherein the computer executable instructions are further configured to establish the location of the forbidden volume within the coordinate system using the boom.

21. A system for controlling a boom of a crane in proximity of obstacles at a worksite, comprising:

a) a crane control system configured to control operation of a crane boom;

b) a processor in operable communication with the crane control system; and c) memory in operable communication with the processor, the memory storing data comprising:

i) data representing a coordinate system;

ii) data representing the crane boom;

iii) data representing a forbidden volume; and iv) computer executable instructions for execution by the processor, the computer executable instruction configured to calculate a minimum distance between the crane boom and the forbidden volume based on the data representing the crane boom and the data representing the forbidden volume, and to cause the crane control system to limit movement of the boom based on the calculated minimum distance, wherein the crane control system limits the motion of the boom in response the calculated minimum distance being less than a threshold distance, wherein the data further comprises:

v) a threshold distance value.

22. The system of claim 21, wherein the crane control system stops the motion of the boom in response to the calculated minimum distance being less than a critical distance, wherein the data further comprises:

vi) a critical distance value.

* * * * *